US007431096B2

(12) United States Patent
Fay

(10) Patent No.: US 7,431,096 B2
(45) Date of Patent: Oct. 7, 2008

(54) EMBEDDED FLEX-LOCK SLIP LINER HANGER

(75) Inventor: Peter Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 224 days.

(21) Appl. No.: 11/148,390

(22) Filed: Jun. 8, 2005

(65) Prior Publication Data

US 2006/0278404 A1 Dec. 14, 2006

(51) Int. Cl.
*E21B 43/10* (2006.01)
*E21B 23/00* (2006.01)

(52) U.S. Cl. ..... 166/382; 166/208; 166/216

(58) Field of Classification Search ..... 166/382, 166/208, 213, 217, 216
See application file for complete search history.

(56) References Cited

U.S. PATENT DOCUMENTS

| | | | | |
|---|---|---|---|---|
| 2,879,851 | A * | 3/1959 | Wilson et al. | 166/216 |
| 3,999,605 | A | 12/1976 | Braddick | 166/212 |
| 4,497,368 | A | 2/1985 | Baugh | 166/208 |
| 5,086,845 | A | 2/1992 | Baugh | 166/382 |
| 5,474,126 | A | 12/1995 | Lynde et al. | 166/117.6 |
| 5,542,473 | A * | 8/1996 | Pringle | 166/120 |
| 5,566,762 | A * | 10/1996 | Braddick et al. | 166/382 |
| 6,431,277 | B1 | 8/2002 | Cox et al. | 166/208 |
| 6,722,428 | B2 * | 4/2004 | Yokley | 166/217 |

FOREIGN PATENT DOCUMENTS

| | | |
|---|---|---|
| GB | 2124275 A | 2/1984 |
| WO | WO 93/20329 | 10/1993 |

* cited by examiner

*Primary Examiner*—Jennifer H Gay
*Assistant Examiner*—David Andrews
(74) *Attorney, Agent, or Firm*—Shawn Hunter

(57) ABSTRACT

A liner hanger includes an annular slip seat that radially surrounds a section of the liner being hung. The slip seat contains a plurality of windows that each accommodates at least one intermediate slip seat. The intermediate slip seats, in turn, each contain windows that accommodate a slip element. There are tongue and groove arrangements between the slip seat and the intermediate slip seat as well as between the intermediate slip seat and the slip element that allow axial movement of the slip element to be translated by camming surfaces into radial outward movement of both the intermediate slip seat and the slip element. The imposition of one or more intermediate slip seats, in an embedded or nested relationship, allows for greater radial expansion of the slip elements with respect to the interior liner.

18 Claims, 4 Drawing Sheets

EMBEDDED FLEX-LOCK SLIP LINER HANGER

BACKGROUND OF THE INVENTION

1. Field of the Invention

The invention relates generally to the design of anchoring slip assemblies and, in particular aspects, to the design of liner hanger devices used for suspending a liner within a wellbore.

2. Description of the Related Art

A liner is a tubular member that is usually run inside of wellbore casing and suspended within it. Liners are typically secured within a wellbore by toothed slips that are located on liner hangers. The slips are set by axially translating them with regard to the liner hanger mandrel. As the slips are translated axially, they are cammed radially outwardly by a ramped surface that is fashioned into the mandrel. As the slips move radially outwardly, toothed outer surfaces of the slip will bitingly engage the surrounding casing. This type of arrangement is shown, for example, in U.S. Pat. No. 4,497,368 issued to Baugh, wherein slips that are radially expanded by riding up over cone elements fashioned into the tubular body of the central mandrel. U.S. Pat. No. 5,086,845 issued to Baugh and U.S. Pat. No. 6,431,277 issued to Cox et al. each describe a hanger arrangement wherein load is transferred circumferentially through the slip seat. U.S. Pat. Nos. 4,497,368, 5,086,845, and 6,431,277 are all owned by the assignee of the present invention and are incorporated herein by reference.

A problem with this standard slip setting arrangement is that the amount of radial expansion of the slip elements is limited. The depth of the slip ramp, and thus the amount of camming, is largely limited by the thickness of the slips and slip seat in the mandrel body. These thicknesses are close to the same, with the slips usually being slightly thinner than the slip seat so that the teeth of the slips will not be exposed over the slip seat when the slip is not set. If the needed camming distance is defined as the distance between the outer diameter of the tool and the inner diameter of the casing to hang in, then it is entirely limited by the thickness of the slip. The slip, in turn, is limited in thickness by the stipulation that it rests on the mandrel body and should be thinner than the slip seat. This restriction can be broken by reducing the outer diameter of the portion of the mandrel over which the slips sit. However, this reduced outer diameter and mandrel thickness would result in a decreased pressure rating for the tool, which is undesirable.

A further limitation to camming distance relates to the mechanism used to retain the non-cammed end of the slip element in place upon the mandrel body. In U.S. Pat. No. 5,086,845, the slips are not restrained by any type of structure. However, an overlying tab was later introduced to hold the lower ends of slips in place. This tab arrangement also limits the setting distance of the slips by reducing the degree of freedom of movement that the slip elements have.

The present invention addresses the problems of the prior art.

SUMMARY OF THE INVENTION

The invention provides a liner hanger with an annular slip seat that radially surrounds a section of the liner being hung and is secured to the liner. The slip seat contains a plurality of windows that each accommodates at least one intermediate slip seat. The intermediate slip seats, in turn, each contain windows that accommodate a slip element. There are camming arrangements between the slip seat and the intermediate slip seat as well as between the intermediate slip seat and the slip element that cause axial movement of the slip element to be translated into radial outward movement of both the intermediate slip seat and the slip element. In a presently preferred embodiment, the camming arrangement is a tongue-and-groove arrangement. The imposition of one or more intermediate slip seats, in an embedded or nested relationship, allows for greater radial expansion of the slip elements with respect to the interior liner. This increased radial expansion allows for the liner hanger to be set within a greater range of casing I.D.s. Additionally, the liner hanger can have a more secure set due to the increased radial expansion range.

Another aspect of the present invention provides an improved linkage between the slip element and the setting sleeve that allows pivoting movement between the slip elements and the setting sleeve. The pivoting linkage better accommodates the increased radial setting distance afforded by the use of intermediate slip seat(s).

DETAILED DESCRIPTION OF THE PREFERRED EMBODIMENTS

Figure 1:
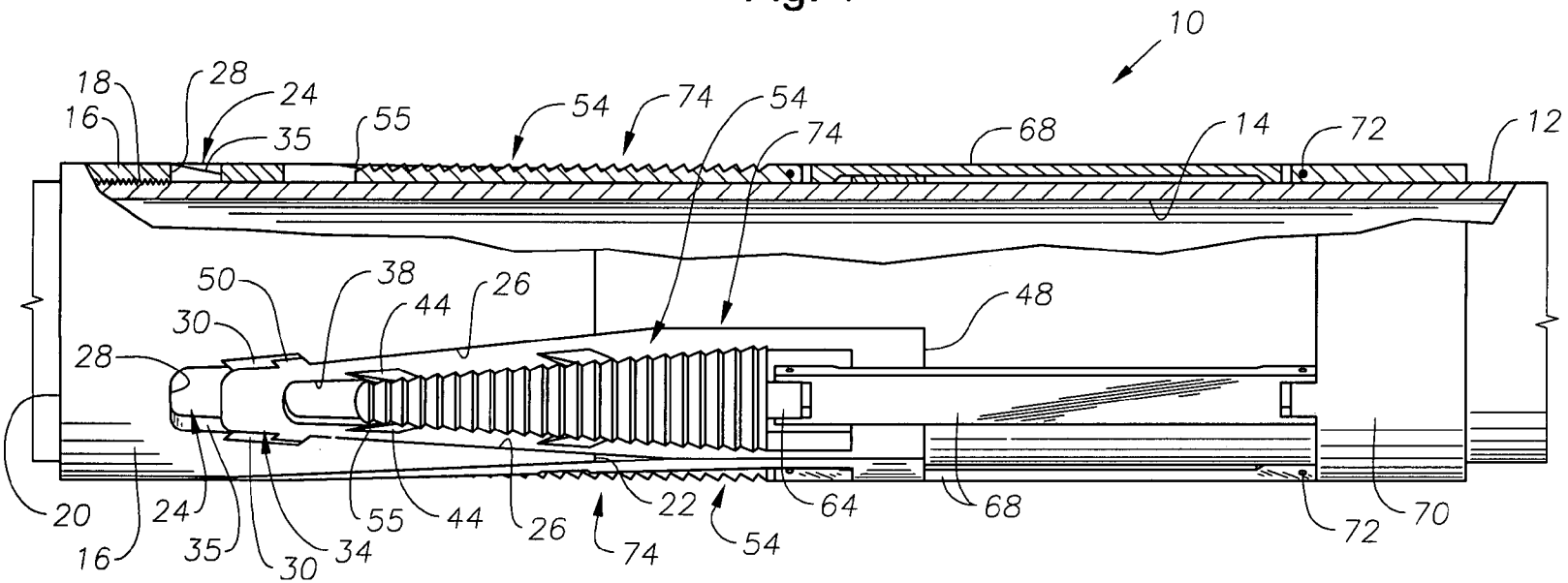
FIG. 1 is a side, partial cross-section of an exemplary flex-lock slip liner hanger constructed in accordance with the present invention and in a run-in configuration.
Figure 2:
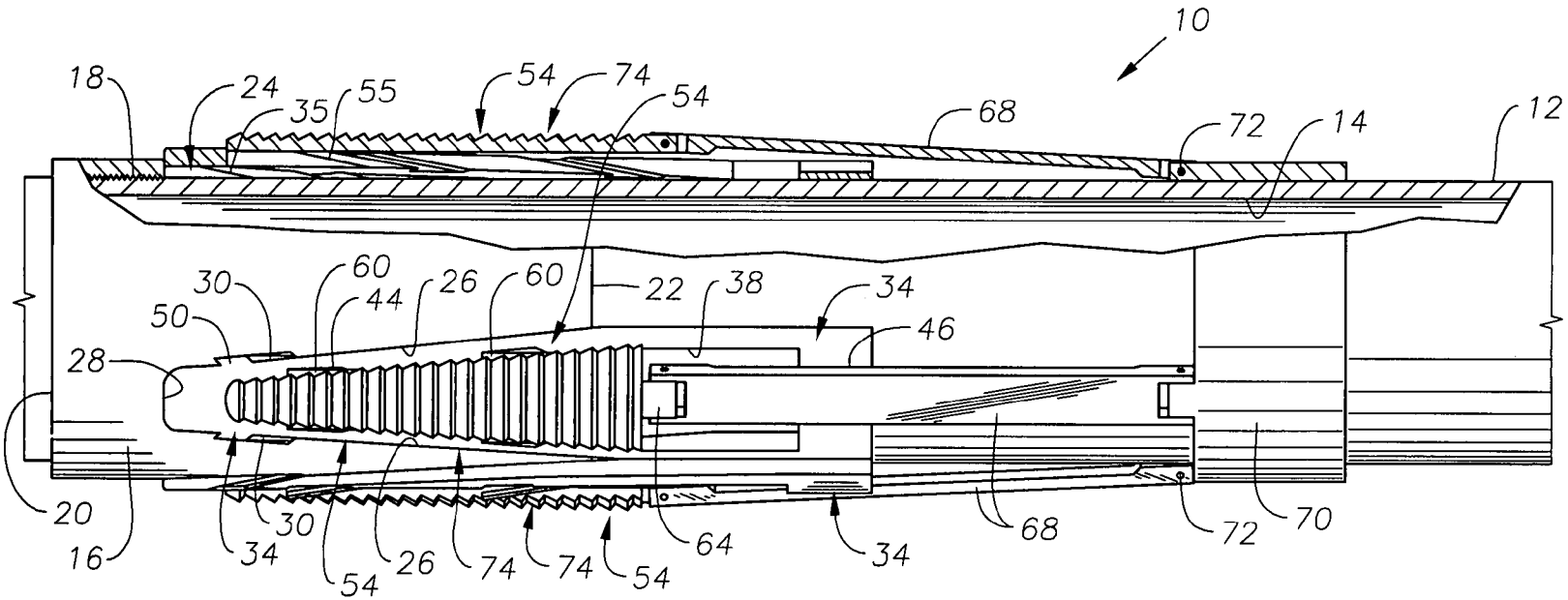
FIG. 2 is a side, partial cross-section of the flex-lock slip liner hanger shown in FIG. 1 now in a set configuration.

FIGS. 1 and 2 depict an exemplary embedded slip-lock liner hanger 10, which is constructed in accordance with the present invention. The liner hanger 10 is shown radially surrounding a tubular liner 12 that will be secured within a surrounding casing (not shown) by the liner hanger 10. The liner 12 defines an axial flowbore 14 along its length for transport of fluids.

The upper end of the liner hanger 10 features a primary slip seat 16 that is fixedly secured to the liner 12 by threaded connection 18. The primary slip seat 16 includes an upper axial end 20 and lower axial end 22. A plurality of angular windows 24 is cut into the primary slip seat 16 in a spaced relation about the circumference of the primary slip seat 16. The number of windows 24 may vary depending upon the number of slips that it is desired to include on the liner hanger 10. Each of the windows 24 have a pair of sidewalls 26 that converge as they approach the upper end 28 of the window 24. Additionally, each sidewall 26 contains a groove 30 that angles radially outwardly as it approaches the upper end 28 of the window 24.

Figure 5:
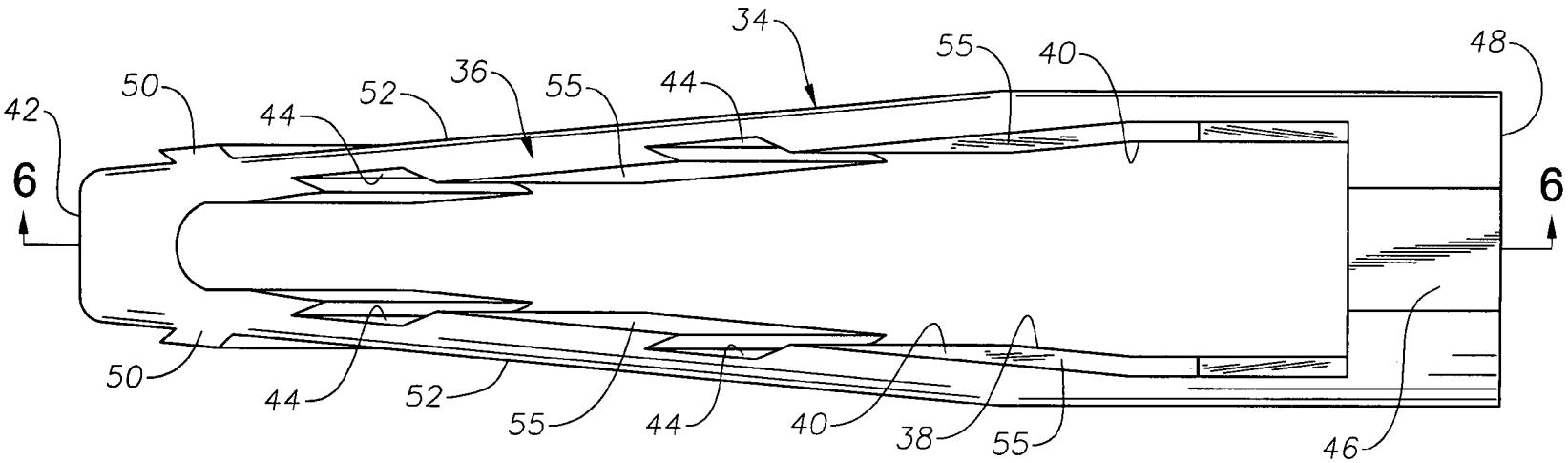
FIG. 5 is a top view of an exemplary intermediate seat used within the liner hanger shown in FIGS. 1-2.
Figure 6:
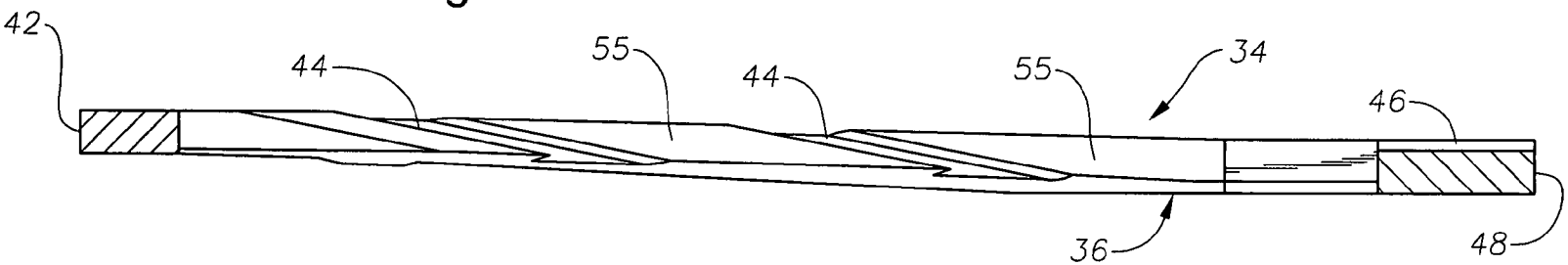
FIG. 6 is a cross-sectional view of the seat depicted in FIG. 5, taken along lines 6-6 in FIG. 5.

An intermediate slip seat 34 is moveably disposed within each of the windows 24. The intermediate slip seat 34 is shown apart from the other components of the liner hanger 10 in FIG. 5 and 6. The intermediate slip seat 34 includes a generally wedge-shaped seat body 36 that has a central window 38 cut therein. The central window 38 includes sidewalls 40 that converge as they approach the upper end 42 of the seat body 36. Angled grooves 44 are formed into the sidewalls 40. Below the central window 38 is a link recess 46 that extends from the central window 38 to the lower end 48 of the seat body 36. Tongues 50 extend from each lateral side 52 of the seat body 36. The tongues 50 are shaped and sized to be slidably received within the grooves 30 of the slip seat 16. The tongue-and-groove relationship allows axial movement of the intermediate slip seat 34 with respect to the primary slip seat 16. The intermediate slip seat 34 is moved radially outwardly via camming action upon the outer camming surface 35 of the sidewalls 26. Those of skill in the art will understand that other suitable camming arrangements might be used as well, such as inclined planes (i.e, ramps) to perform the function of urging the intermediate seat 34 radially outwardly upon axial movement of the intermediate seat 34.

Figure 3:
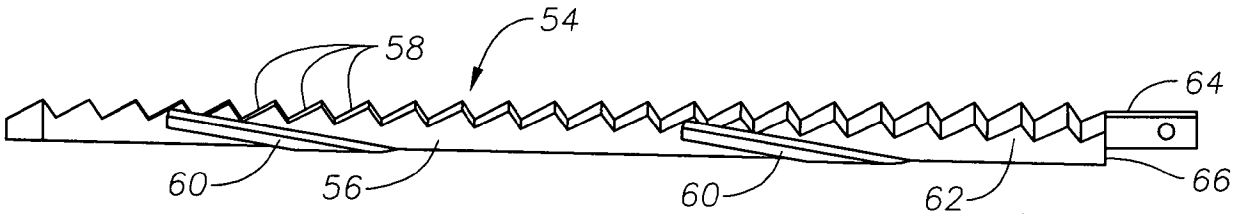
FIG. 3 is a side view of an exemplary slip element used in the liner hanger shown in FIGS. 1 and 2.
Figure 4:
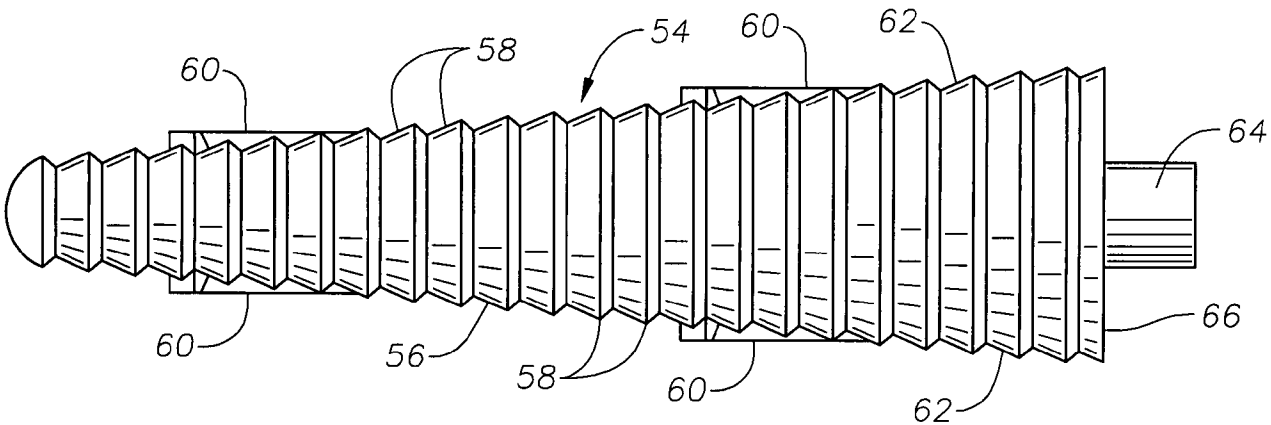
FIG. 4 is a top view of the slip element shown in FIG. 3.

A slip element 54 is disposed within the window 38 of each intermediate seat 34. An exemplary slip element 54 is depicted apart from the other components of the liner hanger in FIGS. 3 and 4. The slip element 54 features a generally wedge-shaped slip body 56 that is shaped to reside within the central window 38 of the intermediate seat 34. A number of engagement teeth 58 extend from the slip body 56 for forming a biting engagement with a surrounding casing or liner. Tongues 60 extend laterally from the sidewalls 62 of the slip body 56 and are disposed within the grooves 44 of the intermediate slip seat 34. This tongue-and-groove relationship allows axial movement of the slip element 54 with respect to the intermediate slip seat 34. In addition, the outer camming surface 55 associated with the grooves 44 will cam the slip element 54 outwardly. Again, those of skill in the art will understand that other suitable camming arrangements might be used as well, such as inclined planes (i.e., ramps) to perform this same function. A hinge portion 64 extends from the lower end 66 of the slip body 56.

As shown in FIGS. 1 and 2, link members 68 extend from each hinge portion 64 to a setting sleeve 70. Each of the link members 68 is interconnected with both the hinge portion 64 and the setting sleeve 70 by pivot pins 72, which permit pivoting movement of the link members 68 with respect to both the hinge portion 64 and the setting sleeve 70.

In operation, the setting sleeve 70 is moved axially by one of several well-known methods, including hydraulic pressure actuation. U.S. Pat. No. 5,086,845 describes details of one type of hydraulic pressure actuation in detail. As the setting sleeve 70 is moved axially upwardly with respect to the liner 12, it is translated from its lower unset position, shown in FIG. 1, to an upper set position, shown in FIG. 2. The slip elements 54 are urged upwardly as well. Upward movement of the slip elements 54 results in the slip elements 54 being moved radially outwardly as well, due to the sliding, camming action upon camming surfaces 55 associated with grooves 44. In addition, the intermediate slip seats 34 will be moved axially upwardly and radially outwardly with respect to the slip seat 16 due to camming action of the slip seats 16 upon camming surfaces 55 associated with grooves 30. Due to the nesting, or embedding, of the slip elements 54 within the intermediate slip seats 34 and further nesting, or embedding, of the intermediate slip seats 34 within the windows 26 of the primary slip seat 16, the slip elements 54 are moved radially outwardly to a greater extent than with prior art arrangements.

A slip element 54, intermediate slip seat 34 and window 24 generally collectively form a single slip assembly 74. There are typically multiple slip assemblies 74 incorporated into a liner hanger 10. Currently preferred embodiments for liner hangers constructed in accordance with the present invention include three or more slip assemblies 74. However, the invention is not limited to any particular number of slip assemblies.

The described embodiment shows a single intermediate slip seat 34 that is nested between the slip element 54 and the slip seat 16. It will be understood however that, for any particular slip assembly 74 there may be multiple intermediate seats similar to intermediate slip seat 34. These would be embedded or nested within one another and each able to move axially and radially with respect to each other.

The liner hanger 10 provides the advantage of providing a greater radial setting distance for the slip elements 54. This greater setting distance is provided by the presence of the intermediate slip seat 34, which is itself radially extended out from the primary slip seat 16 during setting. Thus, the additional radial setting distance provided by the intermediate slip seat 34 is the approximate thickness of the intermediate slip seat 34. Additionally, the pivoting linkage between the setting sleeve 70 and the hinge portion 64 of each slip element 54 better accommodates the increased setting range of the slip elements by allowing freer movement of the slip elements 54.

Those of skill in the art will recognize that numerous modifications and changes may be made to the exemplary designs and embodiments described herein and that the invention is limited only by the claims that follow and any equivalents thereof.

What is claimed is:

1. A slip assembly for a liner hanger comprising:

a primary slip seat for surrounding a liner, the slip seat having a first window therein;

an intermediate slip seat disposed within the first window of the primary slip seat, the intermediate slip seat having a second window therein; and a slip element for creating a biting engagement with a surrounding tubular, the slip element being disposed within the second window and slidingly moveable with respect to the intermediate slip seat.

2. The slip assembly of claim 1 wherein the slip element is interconnected with the intermediate slip seat by a camming arrangement that converts axial movement of the slip element to radial, sliding movement of the slip seat with respect to the intermediate slip seat.

3. The slip assembly of claim 1 wherein the intermediate slip seat is interconnected with the primary slip seat by a camming arrangement that converts axial movement of the slip element to radial movement of the intermediate slip seat.

4. The slip assembly of claim 1 wherein the slip element presents a plurality of engagement teeth for forming a biting engagement with a surrounding tubular.

5. The slip assembly of claim 1 further comprising a link member that extends from the slip element to a setting sleeve, the link member being interconnected to the slip element by a pivotable connection, and wherein axial movement of the setting sleeve moves the slip element axially with respect to the primary slip seat.

6. A liner hanger for securing a section of liner within a surrounding tubular, the liner hanger comprising:

an annular primary slip seat that surrounds a portion of liner to be hung, the primary slip seat having at least one window therein;

an intermediate slip seat axially moveably disposed within one of said first windows, the intermediate slip seat having a second window therein; and a slip element having a plurality of engagement teeth for forming a biting engagement with a surrounding tubular, the slip element being moveably disposed within the second window.

7. The liner hanger of claim 6 further comprising a setting sleeve that is axially moveable with respect to the primary slip seat between unset and set positions, the setting sleeve being in communication with the slip element, such that axial movement of the setting sleeve to its set position urges the slip element axially and radially outwardly.

8. The liner hanger of claim 7 further comprising a link member that extends between the slip element and the setting sleeve.

9. The liner hanger of claim 8 wherein the link member is affixed to the slip element by a pivotable connection.

10. The liner hanger of claim 8 wherein the link member is affixed to the setting sleeve by a pivotable connection.

11. The liner hanger of claim 6 wherein the slip element is associated with the second window of the intermediate slip seat by a camming arrangement that converts axial movement of the slip element to radial movement of the slip element with respect to the intermediate slip seat.

12. The liner hanger of claim 11 wherein the intermediate slip seat is further associated with the first window by a camming arrangement that converts axial movement of the intermediate slip element with radial movement of the intermediate slip seat with respect to the primary slip seat.

13. The liner hanger of claim 8 wherein there are a plurality of intermediate slip seats and an equal number of slip elements.

14. A method of setting a liner hanger within a surrounding tubular, the liner hanger having a primary slip seat, an intermediate slip seat nested within a window in the primary slip seat, and a slip element nested within a window in the intermediate slip seat, the method comprising the steps of:

urging the intermediate slip seat radially outwardly from within the window in the primary slip seat; and moving the slip element axially with respect to the intermediate slip seat to urge the slip element radially outwardly from within the window in the intermediate slip seat to form a biting engagement with the surrounding tubular.

15. The method of claim 14 wherein the slip element is urged radially outwardly from within the window in the intermediate slip seat by sliding.

16. The method of claim 14 wherein the intermediate slip seat is urged radially outwardly from the primary slip seat by camming.

17. The method of claim 14 wherein the step of urging the slip element radially outwardly further comprises pivoting the slip element with respect to a pivotably secured link member.

18. The method of claim 14 wherein the radial movement of the slip element and the intermediate slip seat result from moving a setting sleeve with respect to the primary slip seat.

* * * * *